United States Patent [19]

Bijwaard et al.

[11] Patent Number: 4,764,265

[45] Date of Patent: Aug. 16, 1988

[54] PROCESS FOR THE MANUFACTURE OF LUBRICATING BASE OILS

[75] Inventors: Henricus M. J. Bijwaard, The Hague, Netherlands; Martinus M. P. Janssen, Grand-Couronne, France

[73] Assignee: Shell Oil Company, Houston, Tex.

[21] Appl. No.: 884,945

[22] Filed: Jul. 14, 1986

[30] Foreign Application Priority Data

Jul. 26, 1985 [GB] United Kingdom ..... 8518940

[51] Int. Cl.[4] ..... C10G 71/00

[52] U.S. Cl. ..... 208/18; 208/19; 208/78; 208/80; 208/87; 208/108; 585/13

[58] Field of Search ..... 208/309, 18, 19, 34, 208/36, 33, 28, 27, 254 R, 87, 78, 80, 108; 585/13

[56] References Cited

U.S. PATENT DOCUMENTS

| | | | |
|---|---|---|---|
| 1,809,777 | 6/1931 | Edeleanu | 208/36 |
| 2,498,201 | 2/1950 | Dargle | 208/27 |
| 2,687,982 | 8/1954 | Baumann | 208/36 |
| 2,692,222 | 10/1954 | Puckie | 208/36 |
| 2,853,427 | 9/1958 | Bentley | 208/309 |
| 2,990,362 | 6/1961 | Fox | 208/254 R |
| 3,227,646 | 1/1966 | Jacobson | 208/27 |
| 3,274,096 | 9/1966 | Bushnell et al. | 208/36 |
| 3,278,414 | 10/1966 | Bushnell et al. | 208/36 |
| 3,291,718 | 12/1966 | Biribauer et al. | 208/309 |
| 3,318,800 | 5/1967 | Ringler | 208/27 |
| 3,438,887 | 4/1969 | Morris et al. | 208/28 |
| 3,532,619 | 10/1970 | Rees et al. | 208/27 |
| 3,617,476 | 11/1971 | Woodle | 208/18 |
| 3,652,448 | 3/1972 | Cummins | 208/18 |
| 3,660,273 | 5/1972 | Cummins | 208/18 |
| 3,663,422 | 5/1972 | Dun et al. | 208/28 |
| 3,663,427 | 5/1972 | Thomas et al. | 208/18 |
| 3,702,817 | 11/1972 | Cummins et al. | 208/18 |
| 3,723,295 | 3/1973 | Kress | 208/18 |
| 3,732,154 | 5/1973 | Mills et al. | 208/87 |
| 3,779,896 | 12/1973 | Woodle | 208/18 |
| 3,816,295 | 6/1974 | Coleman et al. | 208/18 |
| 3,912,618 | 10/1975 | Dryer | 208/87 |
| 3,929,616 | 12/1975 | Mead et al. | 208/18 |
| 3,932,267 | 1/1976 | Lewis et al. | 208/87 |
| 3,968,023 | 7/1976 | Yan | 208/87 |
| 4,124,489 | 11/1978 | Reid | 208/87 |
| 4,145,277 | 3/1979 | Miller | 208/254 R |
| 4,181,598 | 1/1980 | Gillespie et al. | 208/18 |
| 4,234,409 | 11/1980 | Schuman et al. | 208/18 |
| 4,259,170 | 3/1981 | Graham et al. | 208/18 |
| 4,268,378 | 5/1981 | Compton | 208/254 R |
| 4,347,121 | 8/1982 | Mayer et al. | 208/18 |
| 4,354,922 | 10/1982 | Derbyshire et al. | 208/87 |
| 4,608,151 | 8/1986 | Miller | 208/33 |

FOREIGN PATENT DOCUMENTS

| | | | |
|---|---|---|---|
| 1493620 | 11/1977 | United Kingdom | 208/18 |
| 1546398 | 5/1979 | United Kingdom | 208/18 |
| 2024852 | 1/1980 | United Kingdom | 208/18 |

*Primary Examiner*—Carl F. Dees
*Assistant Examiner*—Helane Myers
*Attorney, Agent, or Firm*—Kimbely L. Muller

[57] ABSTRACT

Process for the manufacture of lubricating base oils from nitrogen-containing distillate and/or deasphalted oils by catalytic hydrotreatment followed by a dewaxing treatment, which comprises subjecting nitrogen-containing distillates and/or deasphalted oils to solvent extraction and subjecting the raffinate and/or the extract produced to a further treatment to obtain a low-nitrogen fraction and a high-nitrogen fraction and subjecting the low-nitrogen fraction from the extract and/or the high-nitrogen fraction from the raffinate to catalytic hydrotreatment.

13 Claims, No Drawings

PROCESS FOR THE MANUFACTURE OF LUBRICATING BASE OILS

FIELD OF INVENTION

The present invention relates to the manufacture of lubricating base oils as well as to lubricating base oils thus prepared. Lubricating base oils which are used to formulate engine lubricants and industrial oils are normally prepared from suitable petroleum feedstocks, in particular from (vacuum) distillates or deasphalted vacuum residues or mixtures thereof.

BACKGROUND OF THE INVENTION

In the conventional manufacture of lubricating base oils from petroleum feedstocks, fractions obtained from a crude oil and boiling in the desired lubricating base oil range (each range having a separate viscosity range) are separately treated with a suitable solvent to remove primarily undesired aromatic compounds present in the fractions and affecting the properties thereof. Such solvent extraction processes (using, for instance, furfural, N-methyl-2-pyrrolidone, phenol or sulphur dioxide as the extractant) produce lubricating oil raffinates and aromatic extracts.

A nonconventional approach to the preparation of lubricating base oils comprises the catalytic hydrotreatment of suitable feedstocks. The catalytic hydrogenation is normally carried out at rather severe conditions, e.g. at temperatures up to 500° C., and hydrogen pressures up to 200 bar using hydrogenation catalysts such as molybdenum, chromium, tungsten, vanadium, platinum, nickel, copper, iron or cobalt either as such or in the form of their oxides and/or sulphides and either supported on a suitable carrier such as alumina or silica or unsupported. Lubricating base oils having a higher viscosity index are thus prepared as the amount of polycyclic compounds present is reduced substantially. Also, sulphur and nitrogen compounds present in the feedstock to be hydrogenated will be reduced to a very large extent, typically for more than 90%.

Normally, for paraffinic crudes as lube oil feedstocks, a dewaxing treatment is carried out after the solvent extraction process or the hydrogenation process to improve (i.e. to reduce) the pour point of the resulting lubricating base oil. Both solvent dewaxing and catalytic dewaxing can be applied. In the past acid treatments and/or clay treatments have been used to improve the resistance to oxidation of the product and to further improve the color and color stability of the product. Also, a rather mild hydrogenation (also referred to as hydrofinishing) of raffinates has often been applied in this context.

Combinations of various treatments have been suggested extensively in the art with a view to improving one or more properties of the lubricating base oil to be produced.

Also, the technique of blending different lubricating base oils which have been subjected to one or more (pre)-treatments in order to improve the oxidation stability of the resulting mixture can be used advantageously, has been described e.g. in British patent specification No. 2,024,852.

One of the problems still remaining in the manufacture of lubricating base oils from distillates, in particular waxy distillates, and/or deasphalted oils concerns the phenomenon of over-cracking. This may occur when the bulk of a raffinate obtained from solvent extraction is subjected to catalytic hydrotreatment: valuable products are lost as they are either exposed to rather severe hydroprocessing conditions to obtain base oils with the desired properties, or should not have been exposed at all since they already had the required properties. Not only are substantial amounts of useful products lost, also too much reactor volume has to be used.

DETAILED DESCRIPTION OF INVENTION

The present invention presents a solution to this problem by carefully adjusting the amount of material to be subjected to hydroprocessing.

The present invention relates to a process for the manufacture of lubricating base oils from nitrogen-containing distillates and/or deasphalted oils by catalytic hydrotreatment which may be followed by a dewaxing treatment, in which process nitrogen containing distillates and/or deasphalted oils are subjected to solvent extraction and wherein the raffinate and/or the extract produced are subjected to a further treatment to obtain a low-nitrogen fraction and high-nitrogen fraction and subjecting the low-nitrogen fraction from the extract and/or the high-nitrogen fraction from the raffinate to a catalytic hydrotreatment.

By separating the initial extract and/or raffinate into low- and high-nitrogen containing fractions and subjecting the appropriate nitrogen-containing fraction(s) to catalytic hydrotreating, the problem of over-cracking will be reduced substantially. Moreover, a smaller amount of material than usual has to be hydroprocessed which saves valuable reactor space. The material can also be processed under more severe process conditions which allows an increased overall yield.

A wide variety of crude oils can be used to produce the distillates and/or the deasphalted oils to be used as starting material in the process according to the present invention. If desired, the starting materials may be subjected to a demetallization/desulphurization treatment prior to their use in the process according to the present invention. Waxy distillates originating from paraffinic crudes can also be used as starting materials in the process according to the present invention, if desired after having been subjected to a dewaxing treatment, in particular a solvent dewaxing treatment.

The extract to be separated in accordance with the process according to the present invention is suitably obtained by solvent extraction in such a way that the extract comprises up to 65% w, in particular between 30 and 60% w of the initial feedstock.

The separation of the extract into a low-nitrogen fraction and a high nitrogen-fraction can be carried out suitably by partial evaporation of the solvent and/or by lowering the temperature of the extract initially obtained. This provides a further fraction having a lower nitrogen content than the initial extract and leaves a higher (concentrated) nitrogen-containing residual extract. Suitably the temperature may be lowered to 40°-90° C., preferably to 40°-70° C.

The separation of the raffinate (suitably obtained in a yield of at least 35% w by solvent extraction) into a low-nitrogen fraction and a high-nitrogen fraction is conveniently carried out by solvent extraction. In general, the solvent extraction will be carried out in such a way that the low-nitrogen fraction obtained does not contain more than 50% w of the nitrogen compounds initially introduced to this solvent extraction process, depending on the nature of the material used. For light feeds smaller amounts of nitrogen-containing materials can be allowed in the low-nitrogen fraction. For instance, the solvent extraction will be carried out for a spindle raffinate in such a way that the low-nitrogen fraction obtained does not contain more than 15% w of the nitrogen compounds introduced to this solvent extraction.

Preference is given to the use of solvent extraction of the initial raffinate to produce the material to be subjected to a catalytic hydrotreatment since higher overall yields will be obtained and less reactor volume will be needed.

The solvent extraction to be applied to produce the initial extract and raffinate and/or to produce the low- and high nitrogen fractions from the initial raffinate is suitably carried out with solvents such as furfural, phenol or N-methyl-2-pyrrolidone, all having boiling points well below the boiling range of the lubricating base oils so that separation and recovery of the solvent applied is possible by simple flashing. Preference is given to the use of furfural as extractant. In view of the high cost of solvent recovery and the relatively low value of the extract produced, it is important that the maximum amount of raffinate should be produced with the minimum use of solvent. Very good results can be obtained using a rotating disc contactor in the extraction process, especially when the temperature at which the extraction process is carried out is carefully maintained. When use is made of two solvent extraction stages in the process according to the present invention, preferably the same solvent is used in both stages.

The solvent extraction is normally carried out for furfural at temperatures in the range of from 50°–135° C., depending on the type of (dewaxed) distillate to be extracted. Relatively lower boiling distillates are extracted at lower temperatures than higher boiling distillates. Solvent/feed ratios of from 0.4 to 4 can be normally applied for furfural as extractant. By carefully adjusting the temperature and/or the solvent/feed ratio to be applied, the extraction depth can be set at the required level. By raising the temperature and/or the solvent/feed ratio the extraction depth will be increased.

If desired, the high-nitrogen containing fraction obtained by solvent extraction of the initial raffinate may be subjected to a cooling/settler treatment prior to the catalytic hydrotreatment. By recycling the upper part of the product produced in the settler to the solvent extraction process, a more concentrated, i.e. higher-nitrogen containing fraction will be available for the catalytic hydrotreatment which again contributes to the production of lubricating base oils in higher overall yield while having the opportunity of using less reactor volume.

It is an intrinsic part of the process according to the present invention to subject part of all of the low-nitrogen containing fraction obtained from the initial extract and/or part or all of the high-nitrogen containing fraction obtained from the initial raffinate to catalytic hydrotreatment. Preference is given to the use of the high-nitrogen containing fraction obtained from the initial raffinate as feedstock for the catalytic hydrotreatment since the highest yield increase will than be achieved at lower cost.

The catalytic hydrotreatment of the process according to the present invention can be carried out suitably at a temperature in the range of from 290° C. to 425° C., preferably in the range of from 310° C. to 400° C., and most preferably in the range of from 325° C. to 380° C. Hydrogen pressures in the range of from 80 to 200 bar can be suitably applied. Preference is given to the use of pressures in the range of from 90 to 160 bar, in particular in the range of from 100 to 150 bar. The hydroprocessing stage according to the present invention is suitably applied at a space velocity of 0.5 to 1.5 $t/m^3.h$. Preference is given to the use of a space velocity in the range of 0.5 to 1.2 $t/m^3/h$.

Pure hydrogen may be used in the catalytic hydrotreatment but this is not necessary. A gas with a hydrogen content of 60% or more by volume is perfectly suitable. In practice, it will be preferable to use a hydrogen-containing gas originating from a catalytic reforming plant. Such a gas not only has a high hydrogen content but also contains low-boiling hydrocarbons, for example methane, and a small quantity of propane. The hydrogen/oil ratio to be applied is suitably in the range between 300 and 5,000 standard liters (liters at 1 bar and 0° C.) per kg of oil.

If desired, the low-nitrogen containing fraction obtained from the initial raffinate can also be subjected to catalytic hydrotreatment. Care should be taken to apply a rather mild hydrotreatment since the low-nitrogen containing fraction has been obtained specifically in order not to become exposed to the catalytic hydrotreatment to be applied to the high-nitrogen containing fraction. A mild hydrotreatment contributes to improved product properties. Suitably, the mild hydrotreatment is carried out at a temperature between 200° C. and 350° C., a hydrogen partial pressure between 40 and 125 bar, a space velocity in the range of from 0.5 to 1.5 $t/m^3.h$ and a hydrogen/low-nitrogen fraction ratio between 300 and 2,000 standard liters per kg of low-nitrogen fraction.

Catalysts which can be suitably applied in the hydroprocessing stage of the process according to the present invention comprise one or more metals of Groups VIB and VIII of the Periodic Table of the Elements, or sulphides or oxides thereof, which may be supported on a carrier comprising one or more oxides of elements of Groups II, III and IV of the Periodic Table of the Elements, which catalysts may also comprise one or more promoters.

Preference is given to catalysts comprising one or more of the metals molybdenum, chromium, tungsten, platinum, nickel, iron and cobalt or their oxides and/or sulphides, either supported on a suitable carrier, or unsupported. Particularly advantageous catalysts comprise combinations of one or more Group VIII metals (iron, cobalt, nickel) and one or more Group VIB metals (chromium, molybdenum and tungsten) such as cobalt and molybdenum, nickel and tungsten and nickel and molybdenum supported on alumina.

The amounts of the metals present in the catalysts may vary between wide limits. Very suitably, the catalyst contains at least 10 parts by weight of a Group VIB metal and/or at least 3 parts by weight of a Group VIII metal per 100 parts by weight of carrier. Amounts as high as 100 parts by weight of a Group VIB metal and/or a Group VIII metal per 100 parts by weight of carrier can also be used.

The catalysts are preferably used in their sulphidic form. Sulphidation of the catalysts may be effected by any one of the techniques for sulphidation of catalysts well known in the art.

If in the hydroprocessing stage of the process according to the present invention a catalyst is employed comprising nickel and tungsten and which has been prepared by the xerogel route (i.e. by incorporation of the metals into the xerogel as described in British patent specification Nos. 1,493,620 and 1,546,398, all of the teachings of which are herein incorporated by reference) preference is given to a catalyst comprising 3–12 parts by weight of nickel and 20–75 parts by weight of tungsten per 100 parts by weight of alumina.

If in the hydroprocessing stage of the process according to the present invention a catalyst is employed comprising nickel and tungsten and which has been prepared by the hydrogel route (i.e. by incorporation of the metals into the hydrogel as described in British patent specification Nos. 1,493,620 and 1,546,398), preference is given to a catalyst comprising 25–50 parts by weight of nickel and 50–80 parts by weight of tungsten per 100 parts by weight of alumina.

If in the hydroprocessing stage of the process according to the present invention a catalyst is employed comprising nickel and/or cobalt, and, in addition, molybdenum, preference is given to a catalyst comprising 25–80 parts by weight of nickel and/or cobalt and 50–80 parts by weight of molybdenum per 100 parts by weight of alumina.

Normally, the catalysts to be applied in the catalytic hydrotreatment will contain fluorine. Preferably, the quantity of fluorine present in the catalysts ranges from 0.5–10 parts by weight per 100 parts by weight of alumina if they have been prepared by the xerogel route and 10–25 parts by weight per 100 parts by weight of alumina if they have been prepared by the hydrogel route.

Part or all of the fluorine compound, as the case may be, may very suitably be incorporated into the catalyst by in-situ fluorination which may be carried out by adding a suitable fluorine compound, such as o-fluoro toluene or difluoro ethane to the gas and/or liquid stream which is passed over the catalyst.

Part or all of the hydrotreated product(s) obtained by the process according to the present invention may be subjected, if desired, to a dewaxing treatment to further improve the properties of the final lubricating base oils. Preferably, the hydrotreated product obtained by the catalytic hydrotreatment of the high-nitrogen containing fraction obtained from the initial raffinate is subjected to a dewaxing treatment together with part or all of the low-nitrogen fraction obtained from the intial raffinate which fraction may have been subjected to a mild hydrotreatment.

Suitable dewaxing treatments are solvent dewaxing and catalytic dewaxing. Solvent dewaxing is suitably carried out by using two solvents, one of which dissolves the oil and maintains fluidity at low temperatures (methyl isobutyl ketone and, in particular, toluene being well known solvents for this purpose) and the other which dissolves little wax at low temperatures and which acts as a wax precipitating agent (methyl ethyl ketone being a well known agent for this purpose). Propane and chlorinated hydrocarbons such as dichloro methane can also be used. Normally, the product to be dewaxed is mixed with the solvents and heated to ensure solution. The mixture is then cooled down to filtration temperature, usually in the range of from −10° C. to −40° C. The cooled mixture is then filtrated and separated wax washed with cooled solvent. Finally, the solvents are recovered from the dewaxed oil and from the separated wax by filtration and recirculation of the solvents into the process.

Catalytic dewaxing is suitably carried out by contacting the hydrotreated product(s) produced according to the process according to the present invention in the presence of hydrogen with an appropriate catalyst. Preferably, the hydrotreated product obtained by the catalytic hydrotreatment of the high-nitrogen containing fraction obtained from the initial raffinate is subjected to a catalytic dewaxing treatment together with part or all of the low-nitrogen fraction obtained from the initial raffinate which fraction may have been subjected to a mild hydrotreatment. Suitable catalysts comprise crystalline aluminum silicates such as ZSM-5 and related compounds, e.g. ZSM-8, ZSM-11, ZSM-23 and ZSM-35 as well as ferrierite type compounds. Good results can also be obtained using composite crystalline aluminum silicates wherein various crystalline structures appear to be present.

The catalytic hydrodewaxing may very suitably be carried out at a temperature of from 250°–500° C., a hydrogen pressure of 5–100 bar, a space velocity of from 0.1–5.0 $kg.l.^{-1}h^{-1}$ and a hydrogen/oil ratio of from 100–2500 standard liters per kilogram of oil. The catalytic hydrodewaxing is preferably carried out at a temperature of from 275°–450° C., a hydrogen pressure of from 10–75 bar, a space velocity of from 0.2–3 $kg.l.^{-1}h^{-1}$ and a hydrogen/oil ratio of from 200–2,000 standard liters per kilogram.

However, in case solvent dewaxing is applied and slack wax is thus co-produced in the dewaxing treatment, it may be advantageous to subject at least part of the slack wax produced to a hydrogen treatment.

The base oil (fractions) produced according to the process according to the present invention can be suitably applied to formulate lubricating oils for many applications, if desired together with one or more base oil fractions of adequate quality which have been obtained via different processes.

ILLUSTRATIVE EMBODIMENTS

The present invention will now be illustrated by the following Example.

EXAMPLE

By subjecting a Middle East lubricating base stock having a viscosity index of 49 and containing 0.1% w nitrogen to solvent extraction with furfural, 85% of a raffinate containing 410 ppm nitrogen is obtained. The raffinate is then subjected to a second furfural extraction to give 51% of a good quality, low-nitrogen fraction and 34% of a high-nitrogen fraction containing 945 ppm nitrogen. When the high-nitrogen fraction is subjected to catalytic hydrotreatment good quality high viscosity index lubricating base oil is obtained. The overall yield of good quality product is 70% (calculated on base stock).

When the experiment is carried out in such a way that the initial extraction gives 90% of raffinate having a nitrogen content of 555 ppm and subjecting the raffinate to further solvent extraction, 51% of a good quality, low-nitrogen fraction can be produced together with 39% of a high-nitrogen fraction containing 1205 ppm nitrogen. When the high-nitrogen fraction is subjected to catalytic hydrotreatment good quality high viscosity index lubricating base oil is obtained. The overall yield of good quality product is 72% (calculated on base stock). When the intial raffinate (90%) is subjected as such to the catalytic hydrotreatment, good quality base oils are produced in 66%, i.e. 6% less than in accordance with the process according to the present invention.

We claim as our invention:

1. A process for the preparation of dewaxed lubricating base oils from nitrogen-containing distillates or deasphalted oils by solvent extracting said distillates or oils in the presence of a first extraction solvent to produce a first extract stream low in nitrogen content comprising between 30% and 60% of said distillate or oils and a first raffinate stream obtained in a yield of at least 35% and high in nitrogen content, recovering said first raffinate and said first extract stream and subjecting said first raffinate stream to a second solvent extraction in the presence of a second extraction solvent to produce a second extract stream low in nitrogen content and a second raffinate stream high in nitrogen content, recovering said second raffinate and said second extract stream, subjecting said second raffinate stream to catalystic hydrotreatment at a temperature in the range of from 290° to 425° C., a hydrogen pressure of from 80 to 200 bar, and a space velocity of from about 0.5 to about 1.5 $tlm^3$.h. to produce a hydrotreated raffinate stream, recovering said first extract stream low in nitrogen content and subjecting said first extract stream to mild hydrotreating at a temperature of from 200° C. to 350° C. and a hydrogen partial pressure of between 40 and 125 bar, and dewaxing, at dewaxing conditions, said hydrotreated second raffinate stream and said mild hydrotreated first extract stream to produce said dewaxed lubricating base oils.

2. The process of claim 1 wherein said first or second or both said first or second extraction solvent is chosen from the group consisting of phenol, furfural, N-methyl-2-pyrrolidone and sulphur dioxide.

3. The process of claim 1 wherein said first and said second solvent extraction is performed under solvent extraction conditions comprising a temperature in the range of from about 50° C. to about 135° C.

4. The process of claim 1 wherein said hydrotreatment conditions comprise a temperature of from 310° C. to about 400° C., a pressure of from about 90 to 160 bar of hydrogen and a space velocity of from about 0.5 to about 1.2 $t/m^3$.h.

5. The process of claim 1 wherein said hydrotreatment is performed in the presence of a hydrotreatment catalyst comprising one or more metals from Group VIB and Group VIII of the Periodic Table.

6. The process of claim 5 wherein said hydrotreatment catalyst comprises one or more metals chosen from the group of molybdenum, chromium, tungsten, nickel and platinum supported on an alumina support.

7. The process of claim 5 wherein said catalyst comprises at least 10 parts by weight of said Group VIB metal and at least 100 parts by weight of said Group VIII metal.

8. The process of claim 7 wherein said catalyst is present in a sulphided form.

9. The process of claim 7 wherein said catalyst is in-situ fluorinated by the presence of a fluorine compound added to said process.

10. The process of claim 1 wherein said hydrotreated second raffinate stream is dewaxed in a solvent dewaxing zone in the presence of a dewaxing solvent to dewax said second raffinate stream and thereby prepare said lubricating base oils.

11. The process of claim 1 wherein said hydrotreated second raffinate stream is dewaxed in a catalytic dewaxing zone in the presence of a dewaxing catalyst at catalytic dewaxing conditions.

12. The process of claim 11 wherein said dewaxing catalyst comprises an aluminosilicate catalyst selected from the group consisting of ZSM-5, ZSM-35, ZSM-11 and a synthetic ferrierite having metals of Group VIII incorporated therewith.

13. The process of claim 11 wherein said catalytic dewaxing conditions comprise a temperature of from about 200° to 500° C., a hydrogen pressure of from 5 to 100 bar and a space velocity of from 0.1 to 5.0 kg.l.h.

* * * * *